US005957097A

United States Patent [19]

Schanz

[11] Patent Number: 5,957,097

[45] Date of Patent: Sep. 28, 1999

[54] INTERNAL COMBUSTION ENGINE WITH AUTOMATIC COMPRESSION RELEASE

[75] Inventor: John William Schanz, Mequon, Wis.

[73] Assignee: Harley-Davidson Motor Company, Milwaukee, Wis.

[21] Appl. No.: 08/910,256

[22] Filed: Aug. 13, 1997

[51] Int. Cl.[6] ..... F01L 1/10; F01L 13/08

[52] U.S. Cl. ..... 123/90.17; 123/182.1

[58] Field of Search ..... 123/182.1, 90.17

[56] References Cited

U.S. PATENT DOCUMENTS

| | | | |
|---|---|---|---|
| Re. 33,411 | 10/1990 | Inoue et al. | 123/198 F |
| 2,682,260 | 6/1954 | Lantz | 123/90 |
| 2,888,837 | 6/1959 | Hellmann | 74/568 |
| 3,511,219 | 5/1970 | Esty | 123/182.1 |
| 3,897,768 | 8/1975 | Thiel | 123/182 |
| 3,901,199 | 8/1975 | Smith | 123/182 |
| 3,981,289 | 9/1976 | Harkness | 123/182 |
| 4,018,203 | 4/1977 | Legros | 123/182 |
| 4,184,468 | 1/1980 | Freyn | 123/182 |
| 4,217,796 | 8/1980 | Donohue | 74/860 |
| 4,332,222 | 6/1982 | Papez | 123/90.17 |
| 4,338,893 | 7/1982 | Pomfret et al. | 123/90.16 |
| 4,378,765 | 4/1983 | Abermeth et al. | 123/321 |
| 4,453,507 | 6/1984 | Braun et al. | 123/182 |
| 4,495,903 | 1/1985 | Asano | 123/90.3 |
| 4,541,372 | 9/1985 | Weiss | 123/90.17 |
| 4,590,905 | 5/1986 | Matsuki et al. | 123/321 |
| 4,610,227 | 9/1986 | Nakano et al. | 123/182 |
| 4,615,312 | 10/1986 | Tsumiyama | 123/182 |
| 4,615,313 | 10/1986 | Tsumiyama | 123/182 |
| 4,651,687 | 3/1987 | Yamashita et al. | 123/182 |
| 4,672,930 | 6/1987 | Sumi | 123/182 |
| 4,696,266 | 9/1987 | Harada | 123/182 |
| 4,708,101 | 11/1987 | Hara et al. | 123/90.16 |
| 4,790,271 | 12/1988 | Onda | 123/182 |
| 4,869,214 | 9/1989 | Inoue et al. | 123/90.16 |
| 4,886,022 | 12/1989 | Nakai | 123/90.17 |
| 4,892,068 | 1/1990 | Coughlin | 123/182 |
| 5,058,539 | 10/1991 | Saito et al. | 123/90.17 |
| 5,065,720 | 11/1991 | Nishiyama et al. | 123/363 |
| 5,085,184 | 2/1992 | Yamada et al. | 123/182.1 |
| 5,816,208 | 10/1998 | Kimura | 123/182.1 |

FOREIGN PATENT DOCUMENTS

| | | | |
|---|---|---|---|
| 403294610 | 12/1991 | Japan | 123/182.1 |

*Primary Examiner*—Andrew M. Dolinar
*Assistant Examiner*—Arnold Castro
*Attorney, Agent, or Firm*—Michael Best & Friedrich LLP

[57] ABSTRACT

An internal combustion engine comprising a cylinder having an exhaust port, a piston movable within the cylinder in a compression stroke, an exhaust valve for opening and closing the exhaust port, and a cam shaft including a cam member for selectively moving the exhaust valve between open and closed positions. The cam shaft includes a radially-extending opening positioned partially through the cam shaft. The engine further includes an auxiliary cam slidably positioned within the opening and movable radially between an operative position, where the exhaust valve is held open during the compression stroke, and an inoperative position. The auxiliary cam extends only partially through the cam shaft. The engine can further include an auxiliary shaft movably (e.g., rotatably) mounted within the cam shaft and adapted to move the auxiliary cam between the operative position and the inoperative position.

25 Claims, 1 Drawing Sheet

INTERNAL COMBUSTION ENGINE WITH AUTOMATIC COMPRESSION RELEASE

FIELD OF THE INVENTION

This invention relates to internal combustion engines and more particularly to an automatic compression release for such engines.

BACKGROUND OF THE INVENTION

When starting internal combustion engines, the relatively large torque required to overcome cylinder compression places a heavy load on the battery and starter motor. In order to reduce the current drain on the battery and starter motor wear, compression release mechanisms have been proposed in the prior art.

SUMMARY OF THE INVENTION

The present invention is embodied in an internal combustion engine comprising a cylinder having an exhaust port, a piston movable within the cylinder in a compression stroke, an exhaust valve for opening and closing the exhaust port, and a cam shaft including a cam member for selectively moving the exhaust valve between open and closed positions. The cam shaft includes a radially-extending opening positioned partially through the cam shaft. The engine further includes an auxiliary cam slidably positioned within the opening and movable radially between an operative position, where the exhaust valve is held open during the compression stroke, and an inoperative position. The auxiliary cam extends only partially through the cam shaft.

The engine can further include an auxiliary shaft movably (e.g., rotatably) mounted within the cam shaft and adapted to move the auxiliary cam between the operative position and the inoperative position. The auxiliary shaft preferably includes a flat portion that is adapted to engage the auxiliary cam when in the inoperative position, and a cylindrical portion that is adapted to engage the auxiliary cam when in the operative position. Preferably, the auxiliary cam is biased toward the inoperative position (e.g., by using a spring positioned within the opening). A collar member can be positioned at least partially around the cam shaft adjacent the opening, and the spring can be positioned between the collar member and the auxiliary cam.

The engine can further comprise a flyweight movable relative to the cam shaft and interconnected with the auxiliary shaft to provide movement to the auxiliary shaft. Preferably, a pivot arm interconnects the flyweight with the auxiliary shaft. For example, the flyweight can be mounted for pivotal movement about a pivot axis relative to the cam shaft, and wherein the pivot arm can be mounted for pivotal movement about the same pivot axis (e.g., on the same pin).

DETAILED DESCRIPTION

Figures 1, 2, 3:
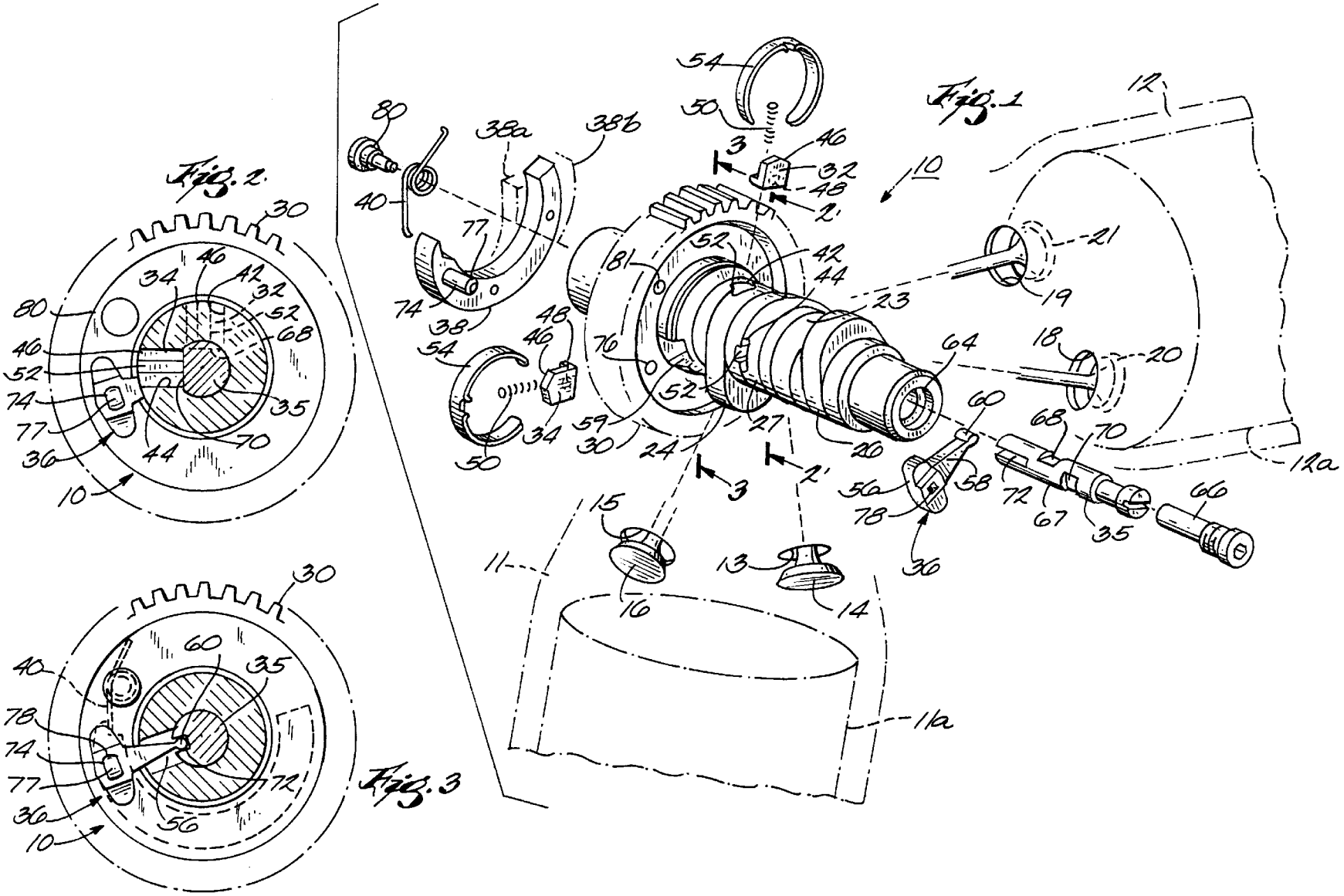
FIG. 1 is an exploded perspective view showing the compression relief assembly according to the preferred embodiment of the invention.
FIG. 2 is a section view taken along line 2—2 of FIG. 1.
FIG. 3 is a section view taken along line 3—3 of FIG. 1.

FIG. 1 shows a cam shaft 10 for an internal combustion engine and including a pressure relief assembly according to the preferred embodiment of the invention. The illustrated cam shaft is designed for a Harley-Davidson 1340 cc engine having first and second cylinders 11, 12 arranged at 45° relative to each other, although it will be appreciated that the invention has application to other engines as well. Reciprocating pistons 11*a*, 12*a* are disposed in the two cylinders 11, 12, respectively, for successive intake, compression, power and exhaust strokes. The first cylinder 11 includes an inlet port 13 closable by an inlet valve 14 and an exhaust port 15 closable by an exhaust valve 16, and the second cylinder 12 similarly includes inlet and exhaust ports 18, 19 closable by inlet and exhaust valves 20, 21, respectively. While all of the valves are shown in FIG. 1 to be open for purposes of illustration, it will be appreciated that only one valve per cylinder typically will be open at any time in the engine cycle.

Fixed to the cam shaft 10 at appropriate angles are lobes 23, 24 for moving the inlet and exhaust valves 14, 16, respectively, of the first cylinder 11. Similarly, lobes 26, 27 are provided for moving the inlet and exhaust valves 20, 21, respectively, of the second cylinder 12. Also mounted on the cam shaft 10 is a cam gear 30. Those skilled in the art will appreciate that the cam gear 30 meshes with a timing pinion or the like (not shown) which, in turn is driven by the vehicle's crankshaft (not shown). The timing pinion rotates the cam shaft 10 at the appropriate speed and rotational angle so that the lobes 23, 24, 26, 27 operate the respective intake and exhaust valves at the appropriate time in the cycle of the cylinders 11, 12. It will be appreciated that while a single cam shaft 10 having four lobes is shown, the invention is also applicable to engines having plural cam shafts as well.

Also mounted on the cam shaft 10 are first and second auxiliary cams 32, 34 and an auxiliary cam operating means which includes an auxiliary shaft in the form of a pivot shaft 35 disposed within the hollow interior of the cam shaft 10 and a pivot arm or lever 36 for moving the auxiliary cams 32, 34 between operative and inoperative positions. A flyweight 38 is coupled to the arm 36 for moving the arm from the operative position to the inoperative position under the influence of centrifugal force when the engine operates at idle speed or higher, and a biasing spring 40 is coupled to the flyweight for biasing the pivot arm 36 to its operative position at relatively low speeds.

The first auxiliary cam 32 is received in a radially extending slot 42 formed in the base circle of exhaust cam lobe 24 and auxiliary cam 34 is received within a radially extending opening in the form of a slot 44 formed in the base circle of exhaust cam lobe 27. Each auxiliary cam 32 and 34 is a relatively flat member having an arcuate end surface 46 whose radius of curvature is less than that of the base circles of the exhaust cam lobes 24, 27. Each of the auxiliary cams 32 and 34 also includes a laterally extending foot 48 which are engaged by coil springs 50 disposed in radially extending holes 52 formed adjacent the slots 42, 44. Collar members in the form of clip springs 54 engage the cam shaft 10 and cover the outer ends of the holes 52 for retaining the springs 50 therein. In this manner, each of the auxiliary cams 32, 34 is biased radially inwardly by their respective coil springs 50.

The pivot arm 36 has an enlarged head 56 and a stem 58 which extends into a third slot 59 formed radially in the shaft 10 adjacent the cam gear 30. A lobe 60 is formed at the inter end of stem 58.

The cam shaft 10 has an axial bore 64 for receiving the pivot shaft 35, and its open end is closed by a set screw 66 which retains the pivot shaft 35 in position. The pivot shaft 35 has a generally cylindrical outer surface 67 except for two flat areas 68, 70 which are spaced apart axially a distance equal to that between the auxiliary cams 32 and 34. In addition, the flat areas 68, 70 are displaced at a radial angle which is equal to the angular equivalent of the timing between lobes 24, 27 as determined by engine performance requirements and is equal to the centerline variation between lobes 24, 27. In the illustrated embodiment, that angle is 97° 24'. The end 72 of pivot shaft 35 is forked for receiving the lobe 60 of pivot arm 36.

The flyweight 38 may have any convenient shape, but in the illustrated embodiment is generally arcuate and is pivotally mounted on the side of the gear 30 opposite the pivot arm 36 by means of a pin 74 which is fixed to the flyweight 38 and extends through a hole 76 in gear 30. The end 77 of the pin 74 is oval shaped for being received within a corresponding oval hole 78 formed in the head 56 of the pivot arm 36. The biasing spring 40 is mounted on the opposite face of the gear 30 by means of the pin 80 which extends into a hole 81. The spring 40 engages the flyweight 38 and the rim of the gear 30 for urging the flyweight in a radially inward direction and into an operative position 38*a* shown by broken lines in FIG. 1.

When the engine is off or running at very low speeds, such as during starting, the biasing force of spring 40 is sufficient to retain the flyweight 38 in its operative position 38*a*. This maintains a pivot arm 36 in a first position wherein the pivot shaft 35 is in an angular position in which the feet 48 of each of the auxiliary cams 32, 34 engages the cylindrical surface 67 of the pivot shaft 35. Each of the auxiliary cams 32, 34 are positioned 180° from their respective exhaust cam lobes 24, 27 and the auxiliary cams 32, 34 and the cam shaft 10 are so proportioned that when the feet 48 engage the cylindrical surface 67 of the pivot shaft 35, the arcuate surfaces 46 extend slightly above the level of the base circle of the exhaust cam lobes 24, 27. As a result, during the compression stroke of each cylinder 11, 12, the exhaust valves 16, 21 are open slightly. This vents the respective cylinders 11, 12 so that the load on the starter motor and battery is substantially reduced. This continues so long as the engine is running at a relatively low speed.

When the engine begins running under its own power and at about idle speed, the centrifugal force on the flyweight 38 is sufficient to pivot its end radially outward toward the rim of the gear 30 so that it moves from the operative position 38*a* to the inoperative position 38*b* shown in FIG. 1. This movement rocks the pivot arm 36 clockwise as viewed in FIG. 1 so that the pivot shaft 35 rotates about its axis until the flats 68, 70 are engaged by the feet of auxiliary cams 32, 34. This permits the auxiliary cams 32, 34 to be moved radially inward relative to the cam shaft 10 under the influence of the springs 50. The auxiliary cams 32, 34 and their respective slots 42, 44 are positioned such that when in this position, the arcuate surfaces 46 are below that of the base circles of the cam lobes 24, 27. As a result, the auxiliary cams 32, 34 do not effect the operation of the exhaust valves 16, 21.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

While only a single embodiment of the invention has been illustrated and described, it is not intended to be limited thereby but only by the scope of the appended claims.

What is claimed is:

1. An internal combustion engine comprising:

a cylinder having an exhaust port;

a piston movable within said cylinder in a compression stroke;

an exhaust valve for opening and closing said exhaust port;

a cam shaft including a cam member for selectively moving said exhaust valve between open and closed positions, said cam member having a cam surface, said cam shaft including a radially-extending opening positioned at least partially through said cam surface; and an auxiliary cam slidably, positioned within said opening and movable along an axis radial to the camshaft between an operative position, where said exhaust valve is held open during the compression stroke, and an inoperative position.

2. An internal combustion engine as claimed in claim 1, further comprising:

an auxiliary shaft movably mounted within said cam shaft and adapted to move said auxiliary cam between the operative position and the inoperative position.

3. An internal combustion engine as claimed in claim 2, wherein said auxiliary shaft is rotatably mounted within said cam shaft.

4. An internal combustion engine as claimed in claim 1, wherein said auxiliary cam is biased toward the inoperative position.

5. An internal combustion engine as claimed in claim 4, further comprising a spring that biases said auxiliary cam toward the inoperative position.

6. An internal combustion engine as claimed in claim 5, wherein said spring is positioned within said opening.

7. An internal combustion engine as claimed in claim 5, further comprising a collar member positioned at least partially around said cam shaft adjacent said opening, wherein said spring is positioned between said collar member and a portion of said auxiliary cam.

8. An internal combustion engine comprising:

a cylinder having an exhaust port;

a piston movable within said cylinder in a compression stroke;

an exhaust valve for opening and closing said exhaust port;

a cam shaft including a cam member for selectively moving said exhaust valve between open and closed positions;

an auxiliary cam movable between an operative position, where said exhaust valve is held open during the compression stroke, and an inoperative position;

a biasing member biasing said auxiliary cam toward said inoperative position:

a collar member positioned at least partially around said cam shaft, said spring being positioned between said collar member and a portion of said auxiliary cam; and an auxiliary shaft rotatably mounted within said cam shaft and adapted to move said auxiliary cam between the operative position and the inoperative position.

9. An internal combustion engine as claimed in claim 8, wherein said biasing member comprises a spring.

10. An internal combustion engine as claimed in claim 8, wherein said auxiliary shaft includes a flat portion that is adapted to engage said auxiliary cam when in the inoperative position.

11. An internal combustion engine as claimed in claim 10, wherein said auxiliary shaft includes a cylindrical portion that is adapted to engage said auxiliary cam when in the operative position.

12. An internal combustion engine as claimed in claim 8, further comprising a flyweight movable relative to said cam shaft and interconnected with said auxiliary shaft to provide movement to said auxiliary shaft.

13. An internal combustion engine as claimed in claim 12, further comprising a pivot arm interconnecting said flyweight with said auxiliary shaft.

14. An internal combustion engine as claimed in claim 13, wherein said flyweight is mounted for pivotal movement about a pivot axis relative to said cam shaft, and wherein said pivot arm is mounted for pivotal movement about the same pivot axis.

15. An internal combustion engine as claimed in claim 13, further comprising a cam gear mounted on said cam shaft, wherein said flyweight is mounted on a pin that extends through a hole in said cam gear.

16. An internal combustion engine as claimed in claim 15, wherein said pivot arm is mounted on said pin.

17. An internal combustion engine comprising:

a cylinder having an exhaust port;

a piston movable within said cylinder in a compression strike;

an exhaust valve for opening and closing said exhaust port;

a cam shaft having a central axis and including a cam member for selectively moving said exhaust valve between open and closed positions, said cam shaft including a radially-extending opening positioned at least partially through said cam shaft;

an auxiliary cam slidably positioned within said opening and movable along an axis radial to the camshaft between an operative position, where the exhaust valve is held open during the compression stroke, and an inoperative position, said auxiliary cam including an outer end surface adapted to extend out of said opening, said end surface comprising a substantially straight portion that is angled with respect to said central axis.

18. An internal combustion engine as claimed in claim 17, wherein said end surface comprises two substantially straight portions positioned at an angle relative to each other.

19. An internal combustion engine as claimed in claim 18, wherein each of said two substantially straight portions makes up about half of the length of said end surface.

20. An internal combustion engine as claimed in claim 1, further comprising:

an auxiliary shaft movably mounted within said cam shaft and adapted to move said auxiliary cam between the operative position and the inoperative position.

21. An internal combustion engine as claimed in claim 20, wherein said auxiliary shaft is rotatably mounted within said cam shaft.

22. An internal combustion engine as claimed in claim 17, wherein said auxiliary cam is biased toward the inoperative position.

23. An internal combustion engine as claimed in claim 22, further comprising a spring that biases said auxiliary cam toward the inoperative position.

24. An internal combustion engine as claimed in claim 23, wherein said spring is positioned within said opening.

25. An internal combustion engine as claimed in claim 23, further comprising a collar member positioned at least partially around said cam shaft adjacent said opening, wherein said spring is positioned between said collar member and a portion of said auxiliary cam.

* * * * *

UNITED STATES PATENT AND TRADEMARK OFFICE

CERTIFICATE OF CORRECTION

PATENT NO : 5,957,097

DATED : September 28, 1999

INVENTOR(S) : John William Schanz

It is certified that error appears in the above-identified patent and that said Letters Patent is hereby corrected as shown below:

Claim 20, column 6, line 17, delete "claim 1" and insert --claim 17--.

Signed and Sealed this

Fifteenth Day of August, 2000

*Attest:*

Q. TODD DICKINSON

*Attesting Officer*

*Director of Patents and Trademarks*